United States Patent [19]

Serrano et al.

[11] Patent Number: 4,991,606

[45] Date of Patent: Feb. 12, 1991

[54] SMOKING ARTICLE

[75] Inventors: Mark A. Serrano, Greenwich, Conn.; Kenneth S. Houghton, Midlothian, Va.; Harry V. Lanzillotti, Midlothian, Va.; Edward B. Sanders, Richmond, Va.; A. Clifton Lilly, Jr., Chesterfield, Va.; Charles R. Hayward, Midlothian, Va.; John R. Hearn, Richmond, Va.; D. Bruce Losee, Jr., Richmond, Va.

[73] Assignee: Philip Morris Incorporated, New York, N.Y.

[21] Appl. No.: 223,153

[22] Filed: Jul. 22, 1988

[51] Int. Cl.[5] ..... A24D 1/00; A24D 1/02; A24D 1/18

[52] U.S. Cl. ..... 131/359; 131/194; 131/365

[58] Field of Search ..... 131/365, 336, 194, 359, 131/369

[56] References Cited

U.S. PATENT DOCUMENTS

| | | |
|---|---|---|
| Re. 27,214 | 11/1971 | Nakahara . |
| 455,614 | 7/1891 | Gonzalez . |
| 675,185 | 5/1901 | Arnold . |
| 977,635 | 12/1910 | Klein . |
| 1,211,071 | 1/1917 | Brown . |
| 1,244,410 | 10/1917 | Barnby . |
| 1,413,448 | 4/1922 | Wintsch, Jr. . |
| 1,528,237 | 3/1925 | Arnold . |
| 1,770,616 | 7/1930 | Keen . |
| 1,771,366 | 7/1930 | Wyss et al. . |
| 1,798,537 | 3/1931 | Honigbaum . |
| 1,836,237 | 12/1931 | Gonsett et al. . |
| 2,104,266 | 1/1938 | McCormick . |
| 2,471,116 | 5/1949 | Newberger . |
| 2,625,163 | 1/1953 | Jones et al. . |
| 2,804,874 | 9/1957 | Visnick . |
| 2,900,987 | 8/1959 | Campbell . |
| 2,907,686 | 10/1959 | Siegel . |
| 2,976,190 | 3/1961 | Meyer . |
| 3,047,431 | 7/1962 | Bavley et al. . |
| 3,047,432 | 7/1962 | Bavley et al. . |
| 3,065,755 | 11/1962 | Boyd et al. . |
| 3,065,756 | 11/1962 | Davies . |
| 3,081,776 | 3/1963 | Park . |
| 3,089,492 | 7/1963 | Wurzburg et al. . |
| 3,162,199 | 12/1964 | Moll, Jr. . |
| 3,165,105 | 1/1965 | Campbell . |
| 3,200,819 | 8/1965 | Gilbert . |
| 3,219,041 | 11/1965 | Bromberg . |
| 3,236,244 | 2/1966 | Irby, Jr. et al. . |
| 3,258,015 | 6/1966 | Ellis et al. . |
| 3,279,476 | 10/1966 | Noznick et al. . |
| 3,339,557 | 9/1967 | Karalus . |
| 3,356,094 | 12/1967 | Ellis et al. . |
| 3,368,566 | 2/1968 | Avedikian . |
| 3,409,019 | 11/1968 | Chun . |
| 3,410,273 | 11/1968 | Bolles . |
| 3,447,539 | 6/1969 | Briskin et al. . |
| 3,516,417 | 6/1970 | Moses . |
| 3,528,432 | 9/1970 | Stossel . |
| 3,540,456 | 11/1970 | McGlumphy et al. . |
| 3,550,598 | 12/1970 | McGlumphy et al. . |
| 3,584,630 | 6/1971 | Inskeep . |
| 3,608,560 | 9/1971 | Briskin et al. . |
| 3,625,228 | 12/1971 | Dock . |
| 3,643,668 | 2/1972 | Briskin et al. . |
| 3,713,451 | 1/1973 | Bromberg . |
| 3,738,374 | 6/1973 | Bennett . |

(List continued on next page.)

FOREIGN PATENT DOCUMENTS

| | | |
|---|---|---|
| 276250 | 7/1965 | Australia . |
| 769468 | 10/1967 | Canada . |
| 787688 | 6/1968 | Canada . |

(List continued on next page.)

OTHER PUBLICATIONS

Dunhill, A., *The Pipe Book*, (London, 1924), pp. 37–38.

*Primary Examiner*—V. Millin

*Attorney, Agent, or Firm*—Jeffrey H. Ingerman

[57] ABSTRACT

A smoking article in which a flavored aerosol is generated by heat transfer to a flavor bed from the combustion of a carbon heat source is provided. The article generates substantially no sidestream smoke. The transfer of heat from the heat source to the flavor bed is accomplished by convective and radiative heat transfer.

37 Claims, 6 Drawing Sheets

U.S. PATENT DOCUMENTS

| | | |
|---|---|---|
| 3,771,535 | 11/1973 | Mezoff . |
| 3,858,587 | 1/1975 | Cavelli et al. . |
| 3,885,574 | 5/1975 | Borthwick et al. . |
| 3,886,954 | 6/1975 | Hannema et al. . |
| 3,910,287 | 10/1975 | Walton . |
| 3,913,590 | 10/1975 | Sway . |
| 3,916,916 | 11/1975 | Bramucci . |
| 3,921,645 | 11/1975 | Hagman . |
| 3,943,941 | 3/1976 | Boyd et al. . |
| 4,008,723 | 2/1977 | Borthwick et al. . |
| 4,027,679 | 6/1977 | Kaswan . |
| 4,036,224 | 7/1977 | Choporis et al. . |
| 4,061,147 | 12/1977 | Falchi . |
| 4,141,369 | 2/1979 | Burruss . |
| 4,219,032 | 8/1980 | Tabatznik et al. . |
| 4,284,089 | 8/1981 | Ray . |
| 4,286,604 | 9/1981 | Ehretsmann et al. . |
| 4,286,607 | 9/1981 | Claessens . |
| 4,289,149 | 9/1981 | Kyriakou . |
| 4,291,711 | 9/1981 | Berger . |
| 4,340,072 | 7/1982 | Bolt et al. . |
| 4,347,855 | 9/1982 | Lanzillotti et al. . |
| 4,391,285 | 7/1983 | Burnett et al. . |
| 4,466,451 | 8/1984 | Bonnet et al. . |
| 4,474,191 | 10/1984 | Steiner . |
| 4,481,958 | 11/1984 | Rainer et al. . |
| 4,513,756 | 4/1985 | Pittman et al. . |
| 4,570,650 | 2/1986 | Sirota . |
| 4,585,014 | 4/1986 | Fry . |
| 4,596,258 | 6/1986 | Steiner . |
| 4,637,407 | 1/1987 | Bonanno et al. . |
| 4,655,229 | 4/1987 | Sensabauch, Jr. et al. . |
| 4,677,995 | 7/1987 | Kallianos et al. . |
| 4,708,151 | 11/1987 | Shelar . |
| 4,714,082 | 12/1987 | Banerjee et al. . |
| 4,729,391 | 3/1988 | Woods et al. . |
| 4,732,168 | 3/1988 | Resce et al. . |
| 4,756,318 | 7/1988 | Clearman et al. . |
| 4,765,347 | 8/1988 | Sensabauch, Jr. et al. . |
| 4,771,795 | 9/1988 | White et al. . |
| 4,779,631 | 10/1988 | Durocher et al. ..... 131/365 |
| 4,793,365 | 12/1988 | Sensabaugh, Jr. et al. . |

FOREIGN PATENT DOCUMENTS

| | | |
|---|---|---|
| 0117355 | 9/1984 | European Pat. Off. . |
| 0149997 | 7/1985 | European Pat. Off. . |
| 0174645 | 3/1986 | European Pat. Off. . |
| 0212234 | 3/1987 | European Pat. Off. . |
| 0225742 | 6/1987 | European Pat. Off. . |
| 0232166 | 8/1987 | European Pat. Off. . |
| 0236992 | 9/1987 | European Pat. Off. . |
| 0244684 | 11/1987 | European Pat. Off. . |
| 0245732 | 11/1987 | European Pat. Off. . |
| 0254842 | 2/1988 | European Pat. Off. . |
| 0254848 | 2/1988 | European Pat. Off. . |
| 0270916 | 6/1988 | European Pat. Off. . |
| 0270944 | 6/1988 | European Pat. Off. . |
| 0271036 | 6/1988 | European Pat. Off. . |
| 0277519 | 8/1988 | European Pat. Off. . |
| 0280262 | 8/1988 | European Pat. Off. . |
| 0280990 | 9/1988 | European Pat. Off. . |
| 0281967 | 9/1988 | European Pat. Off. . |
| 837934 | 5/1952 | Fed. Rep. of Germany . |
| 1632249 | 12/1970 | Fed. Rep. of Germany . |
| 2416876 | 10/1974 | Fed. Rep. of Germany . |
| 2704218 | 8/1978 | Fed. Rep. of Germany . |
| 2723177 | 11/1978 | Fed. Rep. of Germany . |
| 1436357 | 3/1966 | France . |
| 2278275 | 2/1976 | France . |
| 462558 | 3/1951 | Italy . |
| WO86/02528 | 5/1986 | PCT Int'l Appl. . |
| 640060 | 1/1964 | South Africa . |
| 117898 | 12/1926 | Switzerland . |
| 244844 | 12/1925 | United Kingdom . |
| 1033674 | 6/1966 | United Kingdom . |
| 1081951 | 9/1967 | United Kingdom . |
| 1083761 | 9/1967 | United Kingdom . |
| 1185887 | 3/1970 | United Kingdom . |
| 1431045 | 4/1976 | United Kingdom . |
| 2032244 | 5/1980 | United Kingdom . |
| 2064296 | 6/1981 | United Kingdom . |
| 1597106 | 9/1981 | United Kingdom . |

SMOKING ARTICLE

BACKGROUND OF THE INVENTION

This invention relates to smoking articles which produce substantially no visible sidestream smoke. More particularly, this invention relates to a smoking article in which the sensations associated with the smoking of tobacco are achieved without the burning of tobacco.

A substantial number of previous attempts have been made to produce a smoking article which produces an aerosol or vapor for inhalation, rather than conventional tobacco smoke. For example, Siegel U.S. Pat. No. 2,907,686 shows a smoking article consisting of a charcoal rod and a separate carrier impregnated with flavorants and a synthetic "smoke" forming agent which is heated by the burning charcoal rod. The charcoal rod is coated with a concentrated sugar solution so as to form an impervious layer during burning. It was thought that this layer would contain the gases formed during smoking and concentrate the heat thus formed.

Another smoking article, shown in Ellis et al. U.S. Pat. No. 3,258,015, employs burning tobacco in the form of a conventional cigarette to heat a metallic cylinder containing a source of nicotine, such as reconstituted tobacco or tobacco extract. During smoking, the vapors released from the material inside the metal tube mix with air inhaled through an open end of the tube which runs to the burning end of the smoking article. Ellis et al. U.S. Pat. No. 3,356,094 shows a similar smoking article in which the tube becomes frangible upon heating, so that it would break off and not protrude when the surrounding tobacco had burned away.

Published European patent application No. 0 177 355 by Hearn et al. shows a smoking article which produces a nicotine-containing aerosol by heating, but not burning, a flavor generator. The flavor generator could be fabricated from a substrate material such as almumina, natural clays and the like, or tobacco filler. The flavor generator is impregnated with thermally releasable flavorants, including nicotine, glycerol, menthol and the like. Heating of the flavor generator is provided by hot gases formed as a result of the combustion of a fuel rod of pyrolized tobacco or other carbonaceous material.

Banerjee et al. U.S. Pat. No. 4,714,082 shows a variation of the Hearn et al. article which employs a short fuel element. The performance of the article is said to be improved by maximizing heat transfer between the fuel element and the aerosol generator. This is effected by preventing heat loss by insulation, and by enhancing heat transfer between the burning fuel and the flavor generator by a metallic conductor. A spun glass fiber insulator surrounds the fuel element and aerosol generator assembly.

The Banerjee et al. device suffers from a number of drawbacks. First, the resilient glass fiber insulating jacket is difficult to handle on modern mass production machinery. Second, the glass fibers may become dislodged during shipping and migrate through the pack to rest on the mouth end of the article, giving rise to the potential for the inhalation of glass fibers into the smoker's mouth. Additionally, the use of a metallic heat conductor may be somewhat inefficient because the conductor itself absorbs much of the heat produced by the fuel element.

It would be desirable to be able to provide a smoking article in which a flavored aerosol releasing material is efficiently heated by hot gases formed by the passage of air through, and by radiation from, a carbonaceous heat source.

It further would be desirable to avoid the potential for inhalation of glass fibers by a smoker of such an article.

It still further would be desirable to provide such an article which has both the look and feel of a conventional cigarette.

SUMMARY OF THE INVENTION

It is an object of this invention to provide a smoking article in which a flavored aerosol releasing material is efficiently heated by hot gases formed by the passage of air through, and by radiation from, a carbonaceous heat source.

It is a further object of this invention to avoid the potential for inhalation of glass fibers by a smoker of such an article.

It is a still further object of this invention to provide such an article which has both the look and feel of a conventional cigarette.

In accordance with this invention, there is provided a smoking article having a mouth end and a distal end remote from the mouth end. The smoking article includes an active element at the distal end in fluid communication with the mouth end, and may include a filter adjacent the mouth end. The active element includes a heat reflective substantially cylindrical hollow sleeve having internal and external walls, and having a first end at the distal end and a second end closer to the mouth end. A substantially cylindrical carbon-containing heat source is inserted in the sleeve adjacent the first end of the sleeve. Preferably, the heat source is suspended in the sleeve adjacent the first end and spaced from the interior wall of the sleeve, defining an annular space around the heat source. The heat source has a fluid passage substantially through the center thereof. A flavor bed is provided in the sleeve adjacent the second end thereof, in radiative and convective heat transfer relationship with the heat source. The sleeve is air-permeable adjacent the heat source for admitting air to support combustion of the heat source, and is air-impermeable adjacent the flavor bed to prevent combustion of material in the flavor bed. When the heat source is ignited and air is drawn through the smoking article, air is heated as it passes through the fluid passage. The heated air flows through the flavor bed, releasing a flavored aerosol, and carrying it to the mouth end.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
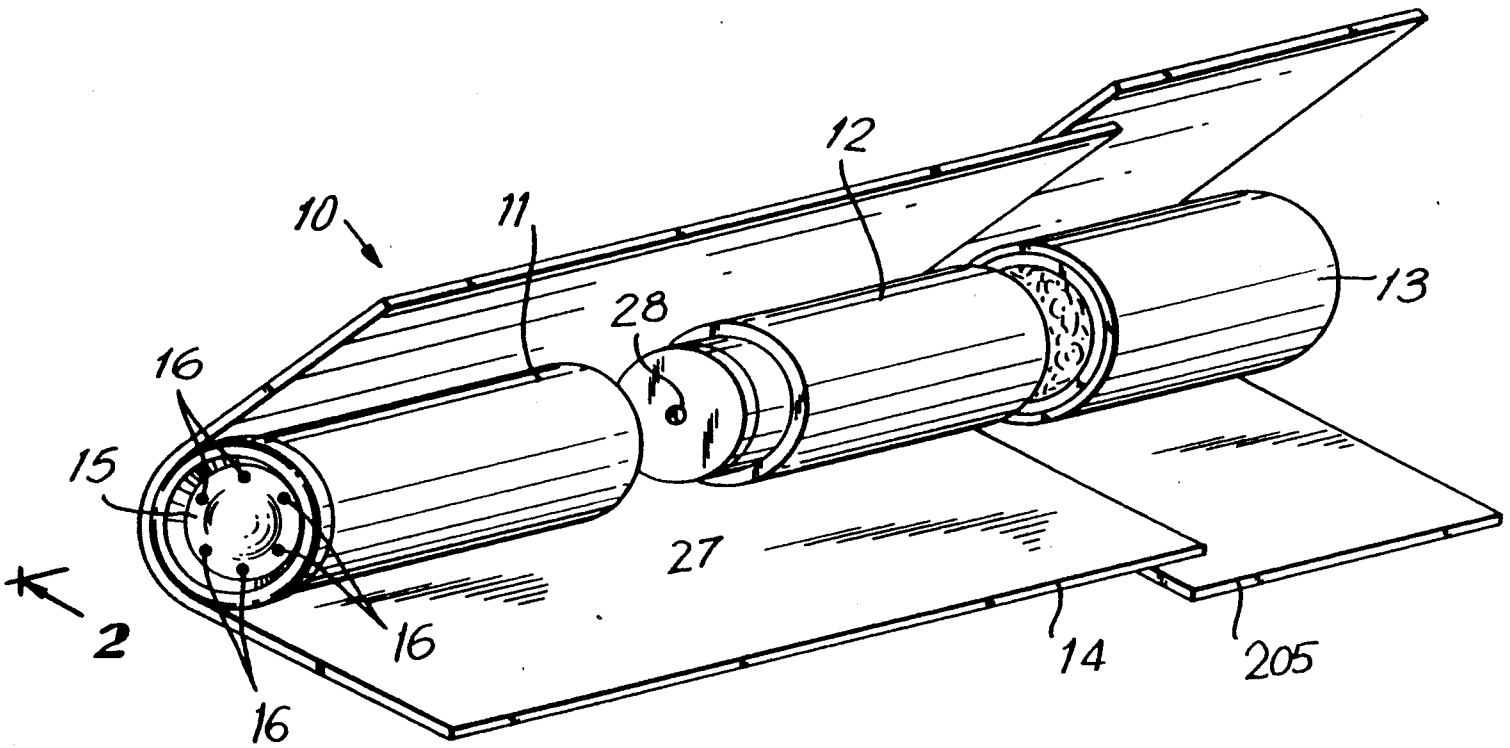
FIG. 1 is an exploded perspective view of a first preferred embodiment of a smoking article according to the present invention.
Figure 2:
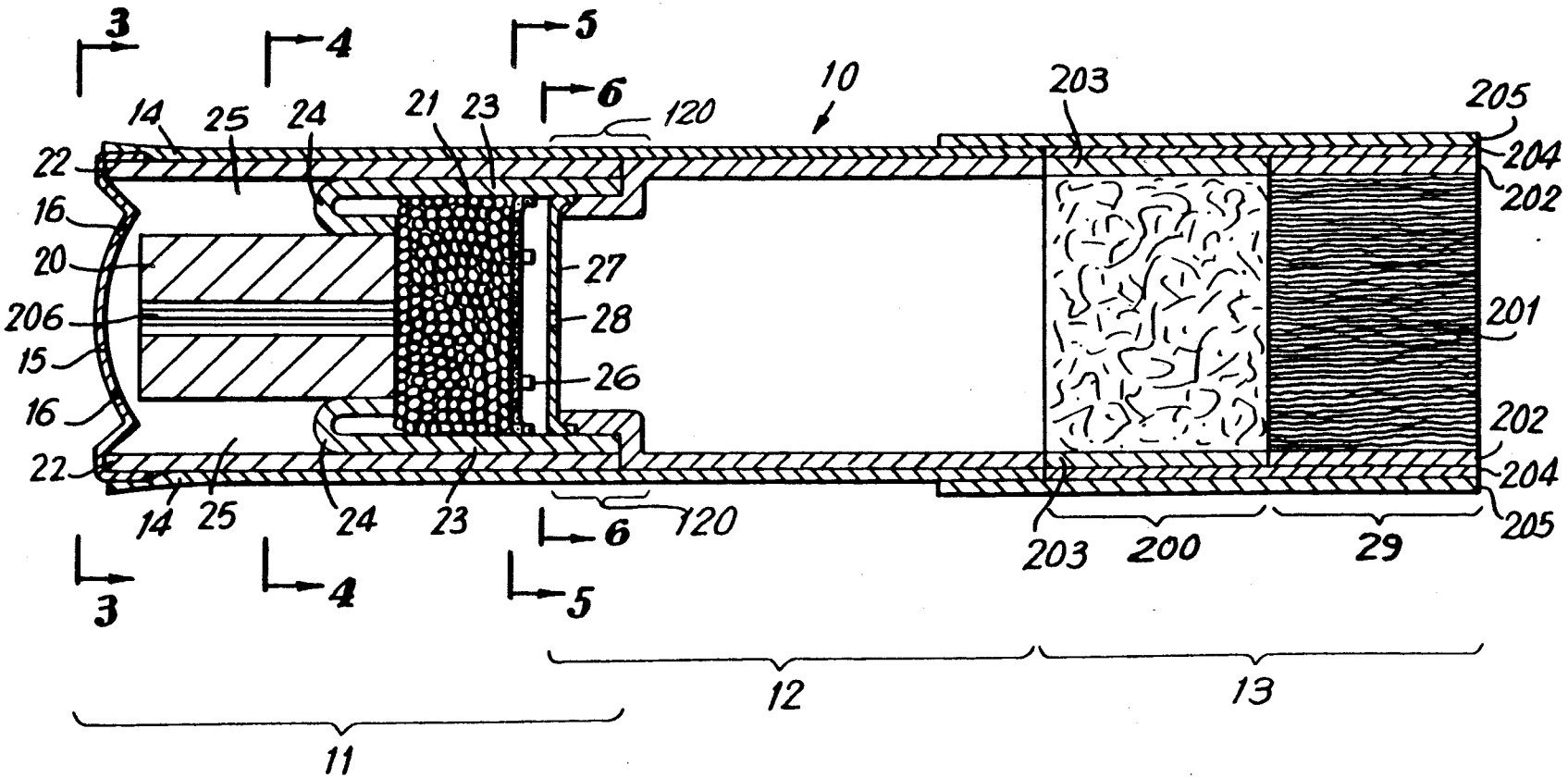
FIG. 2 is a longitudinal cross-sectional view of the smoking article of FIG. 1, taken from line 2—2 of FIG. 1.
Figure 3:
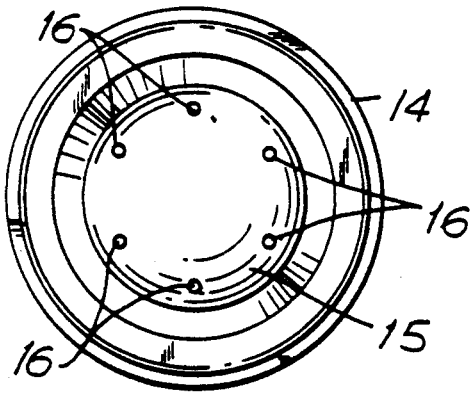
FIG. 3 is an end view of the smoking article of FIGS. 1 and 2, taken from line 3—3 of FIG. 2.
Figure 4:
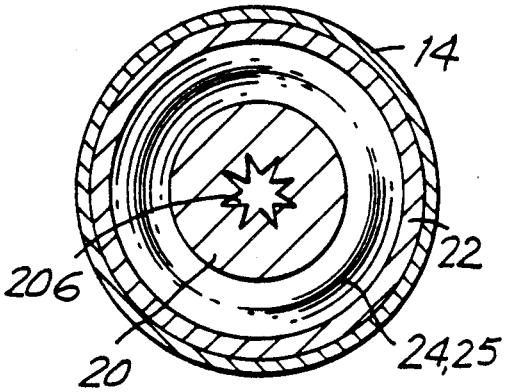
FIG. 4 is a radial cross-sectional view of the smoking article of FIGS. 1-3, taken from line 4—4 of FIG. 2.
Figure 5:
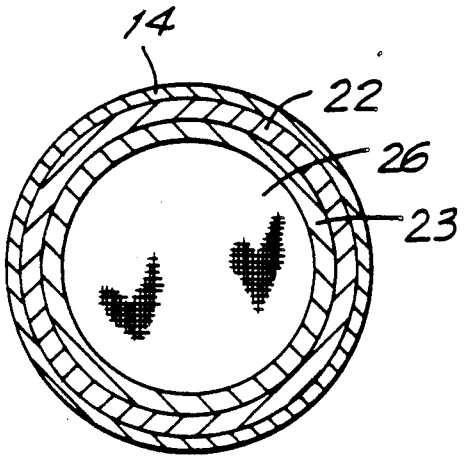
FIG. 5 is a radial cross-sectional view of the smoking article of FIGS. 1–4, taken from line 5—5 of FIG. 2.
Figure 6:
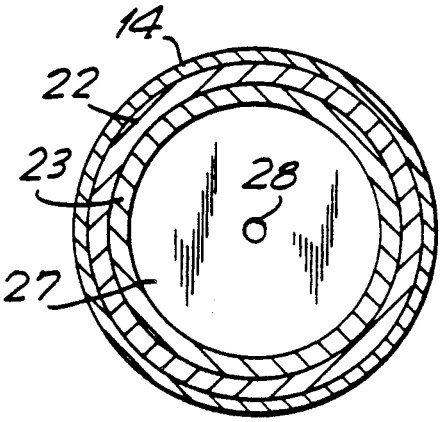
FIG. 6 is a radial cross-sectional view of the smoking article of FIGS. 1–5, taken from line 6—6 of FIG. 2.

A preferred embodiment of a smoking article according to the present invention is shown in FIGS. 1–8. Smoking article 10 consists of an active element 11 and a spacer tube 12, overwrapped by cigarette wrapping paper 14, and a filter element 13 attached by tipping paper 205. Wrapping paper 14 preferably is treated to minimize thermal degradation, such as a magnesium oxide, or other suitable refractory type, cigarette paper. As discussed in more detail below, active element 11 includes a carbon heat source 20 and a flavor bed 21 which releases flavored vapors and gases when contacted by hot gases flowing through the heat source. The vapors pass into expansion chamber tube 12, forming an aerosol which passes to mouthpiece element 13, and thence into the mouth of a smoker.

As explained in more detail in copending U.S. patent application Ser. No. 07/223,232, filed concurrently herewith and hereby incorporated by reference in its entirety, carbon heat source 20 is substantially pure carbon, preferably with some catalysts or burn additives. Carbon heat source 20 preferably is formed from charcoal and has one or more longitudinal passageways therethrough. These longitudinal passageways preferably are in the shape of multi-pointed stars having long narrow points and a small inside circumference. Carbon heat source 20 has a void volume greater than about 50% with a pore size between the charcoal particles of about one to about 2 microns. Carbon heat source 20 has a weight of about 81 mg/10 mm and a density between about 0.2 g/cc and about 1.5 g/cc. The BET surface area of the charcoal particles used in carbon heat source 20 is in the range of about 50 $m^2/g$ to about 2000 $m^2/g$.

Flavor bed 21 can include any material that releases desirable flavors and other compounds when contacted by hot gases. In a smoking article, the flavors and other compounds may be those associated with tobacco, as well as other desirable flavors. Thus, suitable materials for flavor bed 21 may include tobacco filler or an inert substrate on which desirable compounds have been deposited. In a preferred embodiment, described in detail in copending U.S. patent application Ser. No. 07/222,831, filed concurrently herewith and hereby incorporated by reference in its entirety, flavor bed 21 is a packed bed of pelletized tobacco. The pellets are preferably formed by combining in an extruder particularized tobacco materials having a size of from about 20 mesh to about 400 mesh, preferably about 150 mesh, an aerosol precursor, for example, glycerine, 1,3-butanediol or propylene glycol, that can be widely dispersed among the tobacco particles, and a finely divided filler material, for example, calcium carbonate or alumina, to increase the thermal load to prevent the hot gases from raising the temperature of the pellets above their thermal decomposition temperature. The materials are mixed to form a mixture, and the mixture is extruded out a die typically having a plurality of orifices into spaghetti-like strands of about the same diameter. The extruded strands are cut into lengths, preferably of uniform length. The pellets preferably are uniformly dimensioned and comprise a mixture of about 15% to about 95% tobacco material, about 5% to about 35% aerosol precursor, and about 0% to about 50% filler material.

Given sufficient oxygen, as discussed in more detail below, heat source 20 will burn to produce mostly carbon dioxide. As also discussed below, radiant energy reflector sleeve 22 of active element 11 is substantially non-combustible, and does not burn during smoking of article 10. Further, article 10 is constructed in such a way that the gases flowing through flavor bed 21 have a reduced oxygen content, also discussed below, so that the constituents of flavor bed 21 undergo pyrolysis and not combustion even if their temperature is high enough to ignite them otherwise. There is substantially no sidestream when article 10 is smoked.

Turning to the details of the construction of article 10, active element 11 is housed in a composite sleeve including radiant energy reflector sleeve 22 and, preferably, an inner sleeve 23 within radiant energy reflector sleeve 22. (As used herein, unless otherwise indicated, the word "sleeve" refers to the composite sleeve.) Inner sleeve 23 is folded to provide a lip 24 which holds carbon heat source 20 suspended away from the interior wall of radiant energy reflector sleeve 22, leaving an annular space 25. Flavor bed 21 is held within inner sleeve 23 between lip 24 and heat source 20 on one end, and a screen-like clip 26, which holds in the pellets of bed 21 while allowing the aerosol to pass through into expansion chamber tube 12, on the other end. Expansion chamber tube 12 gives article 10 the length, and thus the appearance, of an ordinary cigarette. The distal end of expansion chamber tube 12 is necked-down at 120, and necked-down portion 120 fits into the mouth end of inner sleeve 23. Wrapper 14 holds active element 11 and expansion chamber tube 12 together. Preferably, cigarette wrapping paper 14 will have sufficient porosity to allow air to be admitted through paper 14 and radiant energy reflector sleeve 22 to support combustion of heat source 20. Alternatively, paper 14 may be perforated, such as by laser perforation, in the region of radiant energy reflector sleeve 22 which surrounds heat source 20.

Preferably, aluminum cap 27, fitted over necked-down portion 120, closes off the mouth end of active element 11, leaving only an orifice 28 for the passage of the hot vapors. Passage through orifice 28 causes the hot vapors to increase their velocity and then expand into expansion chamber tube 12. Expansion of the vapors and gases into the expansion chamber causes cooling of the saturated vapors to form a stable aerosol, thereby minimizing condensation on either of mouthpiece segments 29, 200, increasing the delivery of aerosol to the smoker. The degree of expansion, and therefore of cooling, may be controlled by varying the size of orifice 28 and the volume of expansion chamber 12.

Mouthpiece element 13 may be a hollow tube or may include a filter segment 29. Mouthpiece element 13 preferably includes two mouthpiece segments 29, 200. Mouthpiece segment 29 is a cellulose acetate filter plug 201 wrapped in plug wrap 202. Segment 200 is a rod of tobacco filler, wrapped in plug wrap 203, which, in addition to further cooling the aerosol and providing some filtration, may impart additional tobacco taste. The tobacco filler in segment 200 is preferably cut at the standard 30 cuts per inch, but may be coarser to minimize filtration. For example, the tobacco filler may be cut at about 15 cuts per inch. The two segments 29, 200 of mouthpiece element 13 are jointly overwrapped by plug wrap 204, and the entire mouthpiece element 13 is attached to the remainder of article 10 by tipping 205.

Figure 9:
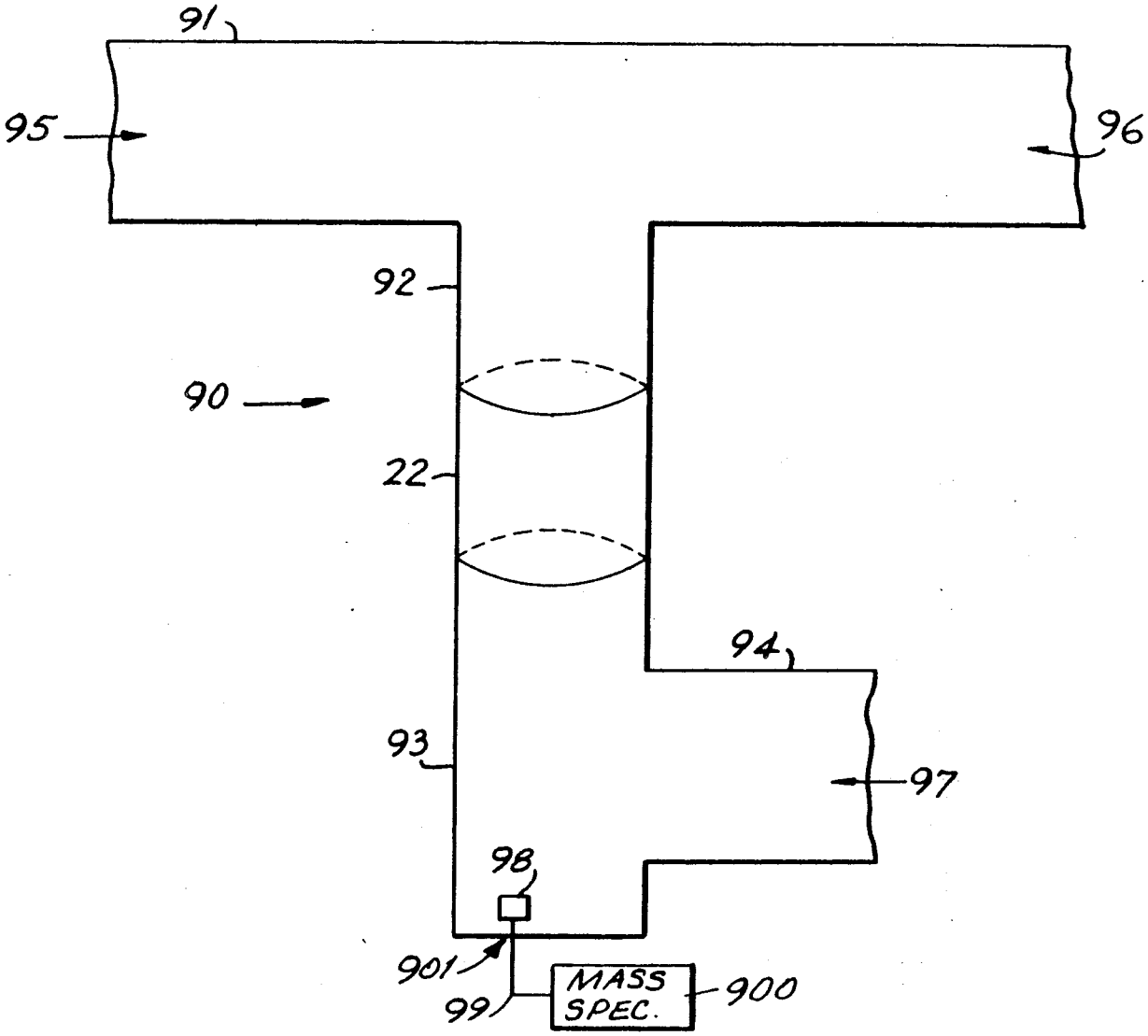
FIG. 9 is a diagram of testing apparatus for measuring permeability of smoking articles according to the invention.

Returning to the structure of active element 11, annular space 25 is provided so that there is sufficient air flow to heat source 20 to allow for sustained combustion and so that conduction of heat to the outside is minimized. For the former reason, radiant energy reflector sleeve 22 is perforated and preferably has at least about 9.5% open area and a permeability of about 9.1 to about 15.1, measured as follows:

A permeability test apparatus 90 as shown in FIG. 9 is assembled from tubing sections 91, 92, 93, 94 all having the same diameter as radiant energy reflector sleeve 22, which is integrated into apparatus 90. Nitrogen gas is pumped into opening 95 at a rate of 2 liters per minute. Opening 96 is open to the atmosphere. Gas is pumped out of opening 97 at a rate of 1 liter per minute. Because resistance to the flow of air through the wall of sleeve 22 is less than that through the tubing of apparatus 90, air will be drawn in through the wall of radiant energy reflector sleeve 22 and out through opening 97 along with a quantity of nitrogen gas. A mass spectrometer probe 98 is positioned at the end of tube section 93 below tube section 94, and is connected by cable 99 to mass spectrometer 900. Cable 99 passes out of tube 94 at 901. The opening through which cable 99 passes is sealed so that no oxygen enters apparatus 90 except through the wall of radiant energy reflector sleeve 22. The permeability of radiant energy reflector sleeve 22 is defined as the number of milliliters of oxygen per minute per square centimeter of surface area of the outer wall of radiant energy reflector sleeve 22 detected by probe 98 as determined by mass spectrometer 900.

The permeability of radiant energy reflector sleeve 22 determines the mass burn rate of heat source 20. It is desirable for article 10 to provide about 10 puffs under FTC conditions (a two-second, thirty-five milliliter puff taken once a minute). If the mass burn rate of heat source 20 is too high, each puff taken by a smoker will deliver added flavor because the gases reaching flavor bed 21 will be hotter. However, because more of heat source 20 is consumed in each puff, heat source 20 may be consumed in fewer than 10 puffs. Similarly, if the mass burn rate is too low, more than 10 puffs will be available, but each will deliver less flavor because the gases will be cooler. In addition, if the mass burn rate is too low, heat source 20 may extinguish before the smoker is ready to take another puff. A preferable mass burn rate has been found to be between about 9 mg/min and about 11 mg/min. To achieve such a range of mass burn rates, a permeability of between about 9.1 and about 15.1, measured in accordance with the method described, is preferred.

The air flow in element 11 into flavor bed 21 is through passage 206 in heat source 20. It is desirable that as large as possible a surface area of heat source 20 be in contact with the air flow to maximize the convective heat transfer to flavor bed 21, and also so that combustion is as complete as possible. For that same reason, passage 206 is not a simple cylindrical passage. Rather, it has a many-sided cross section, such as the eight-pointed star shown in the Figures. In fact, the surface area of passage 206 in the preferred embodiment is greater than the surface area of the outer surface of heat source 20.

Figure 7:
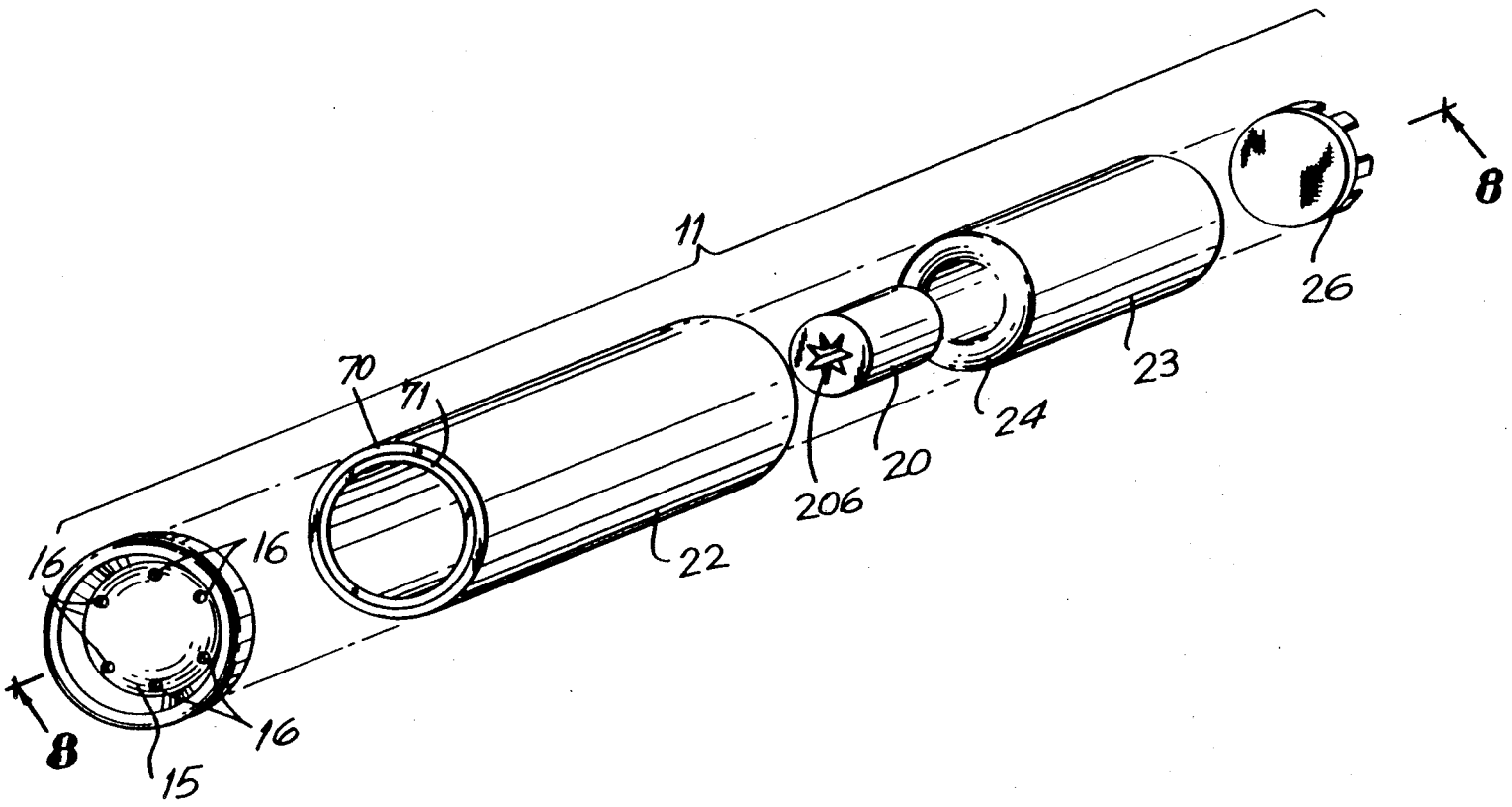
FIG. 7 is an exploded perspective view of the active element of the smoking article according to the invention.
Figure 8:
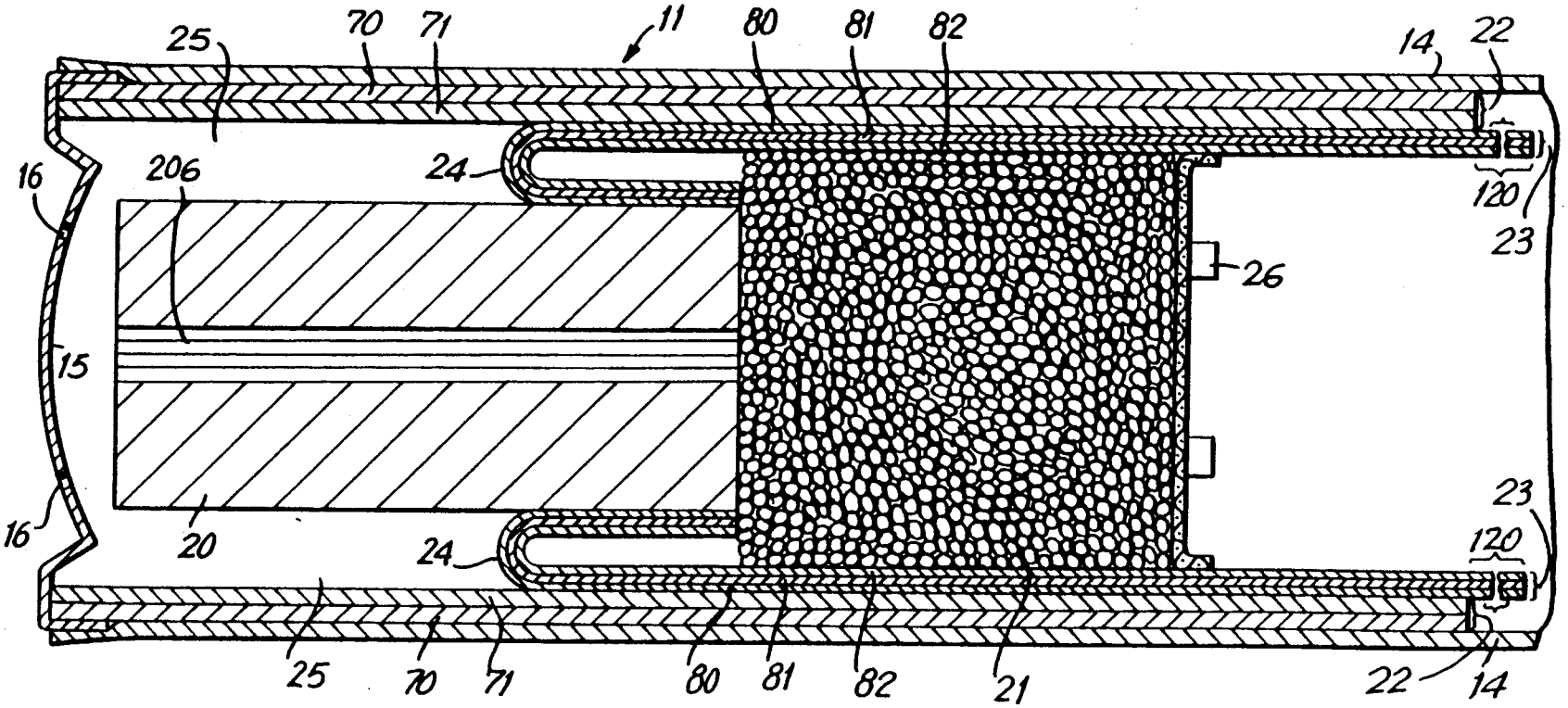
FIG. 8 is a longitudinal cross-sectional view of the active element of the smoking article according to the invention, taken from line 8—8 of FIG. 7.

In order to minimize radiative heat loss from article 10, all inner surfaces of active element 11 are reflectorized. For example, radiant energy reflector sleeve 22 can be made from metallized paper. More preferably, as seen in FIGS. 7 and 8, radiant energy reflector sleeve 22 is made up of a paper layer 70 and an inner foil layer 71. Foil layer 71 reflects heat radiated by heat source 20 back into heat source 20 to keep it hot and thus to ensure that it does not cool below its ignition temperature and become extinguished. The reflection of heat back into active element 11 also means that more heat is available for transfer to flavor bed 21.

Paper layer 70 may be made by spiral winding a paper strip or using other well-known techniques of paper tube-making. Preferably, however, paper layer 70 and foil layer 71 are passed together through a garniture, similar to that used in the making of conventional cigarettes, which forms them into a tube. In that preferred embodiment, the edges of paper layer 70 overlap and are glued to one another. Paper layer 70 is either porous or perforated, so that the required permeability, referred to above, can be achieved. Foil layer 71 is preferably made by taking a standard 0.0015-inch aluminum foil, embossing it to provide raised holes, and then calendering it to flatten the holes so that the perforated foil is more nearly smooth. Although calendering closes up the holes somewhat, the desired permeability is achieved as long as the embossed aluminum sheet has at least 4% open area, preferably about 9.5% open area.

Although foil layer 71 reflects a substantial portion of the heat produced by heat source 20, some of the heat may escape to the outside. For that reason, the paper used in paper layer 70 preferably is modified to prevent combustion so that it does not ignite when article 10 is smoked. For example, the paper may be impregnated with calcium chloride or another hygroscopic flame retardant material. Such a material would have a high latent heat of its own which would allow it to absorb some of the escaping heat, and the water which it absorbs from the surroundings would also have a high heat capacity and a high latent heat of vaporization so that more heat would be absorbed. Finally, some of the heat would be absorbed by the latent heat of pyrolysis of paper layer 70. As a result, there will be insufficient heat to ignite or pyrolize overwrap 14, preventing undue darkening of the overwrap.

Inner sleeve 23 is also reflective, made of an outer aluminum layer 80, an inner aluminum layer 82, and an intermediate paper layer 81. Inner sleeve 23 may be made by taking two identical paper/foil laminate strips and spiral winding them paper side to paper side, so that the two paper sides together form intermediate layer 81. The paper layers are preferably hard-calendered paper. In the preferred embodiment, intermediate layer 81 also includes up to three layers of a paper treated to reduce thermal degradation, such as magnesium oxide, or other suitable refractory type, cigarette paper, wound between the paper/foil laminate strips. Inner sleeve 23 is not made air permeable because flavor bed 21 is to be kept oxygen-deprived, so that no ignition of tobacco can take place which might introduce off tastes and thermal decomposition constituents to the aerosol. The foil layers 80, 82 keep air out, as well as reflecting radiant heat back in for maximum flavor generation. Of course, air could be kept out of flavor bed 21 in other ways, such as overwrapping radiant energy reflector sleeve 22 with an air-impermeable material (not shown) in the region of flavor bed 21. Foil layers 80, 82 should be as thin as possible so that they have low heat capacity, making more heat available to flavor bed 21.

Inner sleeve 23 is folded over to make lip 24, which must be wide enough so that heat source 20 can be held securely in place.

Finally, active element 11 is provided with a reflective end cap 15 which clips over radiant energy reflector sleeve 22 but is covered by wrapper 14. Cap 15 has one or more openings 16 which allow air into active element 11. Openings 16 preferably are located at the periphery of cap 15. In the preferred embodiment, there are six equiangularly spaced openings each having a diameter of 0.080 in. Cap 15 increases the reflection of radiation back into active element 11, and also keeps heat source 20 from falling out of article 10 if it somehow becomes loose. This is important when it is considered that heat source 20 smolders at a high temperature between puffs, and is even hotter during puffs. Cap 15 also keeps in any ash that may form during burning of heat source 20.

It is preferred that article 10 have an outer diameter of 7.9 mm, similar to a conventional cigarette. Carbon heat source 20 preferably has a diameter of 4.6 mm and a length of 10.1 mm, while active element 11 preferably has an overall length of 26 mm. Mouthpiece element 13 preferably has a length of 21 mm, divided between a 10 mm cellulose acetate filter portion 29 and an 11 mm tobacco rod portion 200. Expansion chamber tube 12 preferably is 33 mm long, so that article 10 overall is 79 mm long, which is comparable to a conventional "long-size" cigarette. In the preferred embodiment, lip 24 is 2.6 mm wide.

Thus it is seen that a smoking article in which a flavored aerosol releasing material is efficiently heated by a carbonaceous heat source, which avoids the potential for inhalation of glass fibers by the smoker, which minimizes heat loss to the walls of the flavor bed, and which has both the look and feel of a conventional cigarette, is provided. One skilled in the art will appreciate that the present invention can be practiced by other than the described embodiments, which are presented for purposes of illustration and not of limitation, and the present invention is limited only by the claims which follow.

What is claimed is:

1. A smoking article having a mouth end and a distal end remote from said mouth end, said smoking article comprising:

an active element at said distal end in fluid communication with said mouth end, said active element comprising:

a substantially non-combustible substantially cylindrical hollow sleeve having internal and external walls, and having a first end at said distal end and a second end closer to said mouth end, an outer surface comprising at least one of (a) said external wall, and (b) a wrapper, a heat source contained in said sleeve adjacent said first end, said heat source having a fluid passage therethrough, and a flavor bed in said sleeve adjacent said second end thereof, in radiative and convective heat transfer relationship with said heat source; wherein:

said outer surface has a sufficient porosity to allow air to be admitted through said outer surface adjacent said heat source for continually admitting air to support combustion of said heat source, and is air-impermeable adjacent said flavor bed to prevent combustion of material in said flavor bed; whereby:

when said heat source is ignited and air is drawn through said smoking article, air is heated as it passes through said fluid passage, said heated air flowing through said flavor bed, releasing a flavored aerosol, and carrying it to said mouth end.

2. The smoking article of claim 1 further comprising a mouthpiece element adjacent said mouth end.

3. The smoking article of claim 2 wherein said mouthpiece element comprises a cellulose acetate filter plug adjacent said mouth end.

4. The smoking article of claim 3 wherein said mouthpiece element further comprises a rod of tobacco filler adjacent an end of said filter plug remote from said mouth end.

5. The smoking article of claim 1 wherein said flavor bed comprises tobacco.

6. The smoking article of claim 5 wherein said flavor bed comprises a plurality of tobacco-containing pellets.

7. The smoking article of claim 1 further comprising means for cooling said aerosol.

8. The smoking article of claim 7 wherein said cooling means comprises means for causing expansion of said aerosol.

9. The smoking article of claim 8 wherein said cooling means comprises an orifice at said second end of said active element, for passage therethrough of said aerosol, and an expansion chamber adjacent said orifice toward said mouth end of said smoking article.

10. The smoking article of claim 1 wherein said heat source is solid, ignitable and self-sustaining.

11. The smoking article of claim 1 wherein said heat source is substantially cylindrical.

12. The smoking article of claim 1 wherein said fluid passage is substantially through the center of said heat source.

13. The smoking article of claim 1 wherein said heat source comprises carbon.

14. The smoking article of claim 13 wherein said heat source comprises carbon and at least one burn additive.

15. A smoking article having a mouth end and a distal end remote from said mouth end, said smoking article comprising:

an active element at said distal end in fluid communication with said mouth end, said active element comprising:

a substantially non-combustible substantially cylindrical hollow sleeve having internal and external walls, and having a first end at said distal end and a second end closer to said mouth end, a heat source suspended in said sleeve adjacent said first end and spaced from said interior wall of said sleeve, defining an annular space around said heat source, said heat source having a fluid passage therethrough, and a flavor bed in said sleeve adjacent said second end thereof, in radiative and convective heat transfer relationship with said heat source; wherein:

said sleeve is air-permeable adjacent said heat source for admitting air to support combustion of said heat source, and is air-impermeable adjacent said flavor bed to prevent combustion of material in said flavor bed; whereby:

when said heat source is ignited and air is drawn through said smoking article, air is heated as it passes through said fluid passage, said heated air flowing through said flavor bed, releasing a flavored aerosol, and carrying it to said mouth end.

16. The smoking article of claim 15 wherein said substantially non-combustible sleeve is of metallic foil and paper.

17. The smoking article of claim 16 wherein said metallic foil is aluminum foil.

18. The smoking article of claim 16 wherein said substantially non-combustible sleeve is of a rolled paper/foil laminate.

19. The smoking article of claim 16 wherein said paper is porous and said foil is perforated.

20. The smoking article of claim 16 wherein said paper is non-porous and said paper and said foil are perforated.

21. The smoking article of claim 16 wherein said interior wall of said sleeve is of said metallic foil, said foil reflecting heat produced by said heat source back toward said heat source, to aid in maintaining combustion thereof.

22. The smoking article of claim 15 wherein said sleeve further comprises a heat reflector at said interior wall thereof, for reflecting heat produced by said heat source back toward said heat source, to aid in maintaining combustion thereof.

23. The smoking article of claim 22 wherein said sleeve is of a paper-type material.

24. The smoking article of claim 23 wherein said paper-type material is spiral wound paper.

25. The smoking article of claim 24 wherein said paper is porous.

26. The smoking article of claim 24 wherein said paper is non-porous and is perforated.

27. The smoking article of claim 22 wherein said heat reflector is a sheet of aluminum lining said interior wall.

28. The smoking article of claim 27 wherein said sheet of aluminum is perforated.

29. The smoking article of claim 28 wherein said sleeve has a permeability of about 9.1 to about 15.1, said aluminum sheet having at least about 4% open area.

30. The smoking article of claim 22 wherein said sleeve has a permeability of about 9.1 to about 15.1.

31. The smoking article of claim 15 wherein said sleeve comprises a substantially air-impermeable inner sleeve within said sleeve adjacent said flavor bed.

32. The smoking article of claim 31 wherein said inner sleeve comprises a lip for receiving said heat source.

33. The smoking article of claim 31 wherein said inner sleeve is a laminate of a metallic foil and paper.

34. The smoking article of claim 33 wherein said inner sleeve comprises two metallic foil layers surrounding a paper layer.

35. The smoking article of claim 34 wherein said metallic foil is aluminum foil.

36. The smoking article of claim 15 further comprising a perforated end cap at said distal end of said element, for preventing dropout from said element of said heat source and ash from the combustion thereof.

37. The smoking article of claim 36 wherein said end cap is reflective of radiant energy for reflecting heat back to said heat source, to aid in maintaining combustion thereof.

* * * * *